US005492059A

United States Patent [19]

Reichel

[11] Patent Number: 5,492,059

[45] Date of Patent: Feb. 20, 1996

[54] OFFSET PRINTING FORM AND PROCESS FOR THE PRODUCTION THEREOF

[75] Inventor: Klaus T. Reichel, Augsburg, Germany

[73] Assignee: MAN Roland Druckmaschinen AG, Offenbach, Germany

[21] Appl. No.: 271,129

[22] Filed: Jul. 6, 1994

[30] Foreign Application Priority Data

Jul. 15, 1993 [DE] Germany ..... 43 23 750.9

[51] Int. Cl.[6] ..... B41F 13/10

[52] U.S. Cl. ..... 101/375; 101/376; 101/401.1; 101/DIG. 36

[58] Field of Search ..... 101/216, 217, 101/375, 376, 378, 382.1, 383, 401.1, DIG. 36; 29/132, 188

[56] References Cited

U.S. PATENT DOCUMENTS

| | | | |
|---|---|---|---|
| 1,963,745 | 6/1934 | Ingersoll et al. | 29/188 |
| 3,146,709 | 9/1964 | Bass et al. | 101/375 |
| 3,750,250 | 8/1973 | Brown | 29/198.4 D |
| 4,198,739 | 4/1980 | Budinger et al. | 29/132 |
| 4,643,095 | 2/1987 | Pfizenmaier et al. | 101/401.1 |
| 4,872,407 | 10/1989 | Banke | 101/DIG. 36 |
| 5,351,615 | 10/1994 | Kobler et al. | 101/DIG. 36 X |
| 5,379,693 | 1/1995 | Hoffmann et al. | 101/375 |

FOREIGN PATENT DOCUMENTS

| | | |
|---|---|---|
| 2700118 | 7/1977 | Germany . |
| 3512776 | 10/1986 | Germany . |
| 3532099 | 3/1987 | Germany . |
| 3633155 | 4/1988 | Germany . |
| 4140768 | 6/1993 | Germany . |

*Primary Examiner*—Christopher A. Bennett
*Attorney, Agent, or Firm*—Cohen, Pontani, Lieberman, Pavane

[57] ABSTRACT

An offset printing form comprising at least one printing form made up of at least one driving plate which is of metallic material and cut to size. The printing plate having starting and ending printing edges that are connected with one another so as to form a sleeve. A support for the printing plate is provided in the form of a slightly expandable hollow cylinder. The support is enclosed by an adhesive layer so that the printing plate can be placed on the adhesive layer so as to adhere thereto.

5 Claims, 5 Drawing Sheets

OFFSET PRINTING FORM AND PROCESS FOR THE PRODUCTION THEREOF

BACKGROUND OF THE INVENTION

1. Field of the Invention

The invention is directed to an offset printing form and a process for producing such an offset printing form from at least one printing plate which is cut to size and made of metallic material. The starting and ending printing edges of the printing plate are connected with one another so as to form a sleeve.

2. Description of the Prior Art

The prior German Patent Application P 41 40 768 discloses a sleeve-shaped offset printing form which has a continuous circumferential surface without grooves and can be slid onto a form cylinder and positioned on the latter in a working position in exact register in a frictionally locking manner. The sleeve is produced from a commercial printing plate of metallic material, preferably aluminum, which is cut to size and the forward and rear edges of the plate are connected, e.g. welded, with one another so that, apart from a connecting seam, the sleeve has an uninterrupted circumferential surface. Such a sleeve-shaped offset printing form can be used in combination with a form cylinder, e.g. known from the German Patent DE-PS 27 00 118, having no groove or tensioning segment. The printing form can be slid onto the form cylinder by applying compressed air and the form cylinder can also hold the printing form by means of electromagnets when using a sleeve-shaped multimetal plate. Naturally, it must be possible to switch off the magnetic effect during the process of slipping on the printing form.

The great advantage of such sleeve-shaped printing forms is that commercially available offset printing plates and existing plate copies can be used and, in comparison with printing with the use of a tensioning groove, grooveless printing enables an economical manufacture of the cylinder, improved printing quality and higher printing speeds. The connection seam and accordingly the non-printing region are comparatively small.

SUMMARY OF THE INVENTION

Accordingly, it is an object of the present invention to provide a further improvement in the printing form of the generic type by a further reducing the non-printing region on the printing surface of the sleeve-shaped offset printing form.

Pursuant to this object, and others which will become apparent hereafter, one aspect of the present invention resides in an offset printing form having at least one printing plate which is made of metallic material and is precut to a desired size. The starting and ending edges of the printing plate are connected with one another so that the printing plate forms a sleeve. A slightly expandable hollow cylinder is provided as the support for the printing plate, which expandable hollow cylinder is covered by an adhesive layer. The printing plate is connected to the hollow cylinder by the adhesive layer. The adhesive layer can be a double-sided adhesive foil or an adhesive agent that produces a detachable connection between the printing plate and the support.

In a further embodiment of the invention, the joints between the ends of the printing plate and the ends of the foil are sealed by a solvent-resistant glue.

Another aspect of the present invention resides in a process for producing an offset printing form by pulling a slightly expandable hollow cylinder onto a mounting cylinder, applying an adhesive layer to the hollow cylinder and placing at least one printing plate on the adhesive layer in exact register.

In an offset printing form of the generic type in which printing plates made of aluminum are preferably used, the non-printing area, i.e. the area in which the beginning and ending edges of the printing plate abut, can be considerably reduced by steps of the inventive method, the width of the joining point being only approximately 0.1 min.

The inventive process advantageously economizes on the use of welding, rolling and stamping machines. Furthermore, because of the required press fit, the length of a welded printing plate must be cut off within a tolerance range of ±0.01 mm at the circumference, as opposed to a tolerance range of only ±0.1 mm in a printing plate of the printing form according to the present invention.

The hollow cylinder supporting the printing plate is preferably made of nickel or glass-fiber/carbon fiber-reinforced plastic so that a sleeve is provided which is well suited for the purpose mentioned above, is very economical, and ensures trouble-free operation of the form cylinder with good printing quality.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
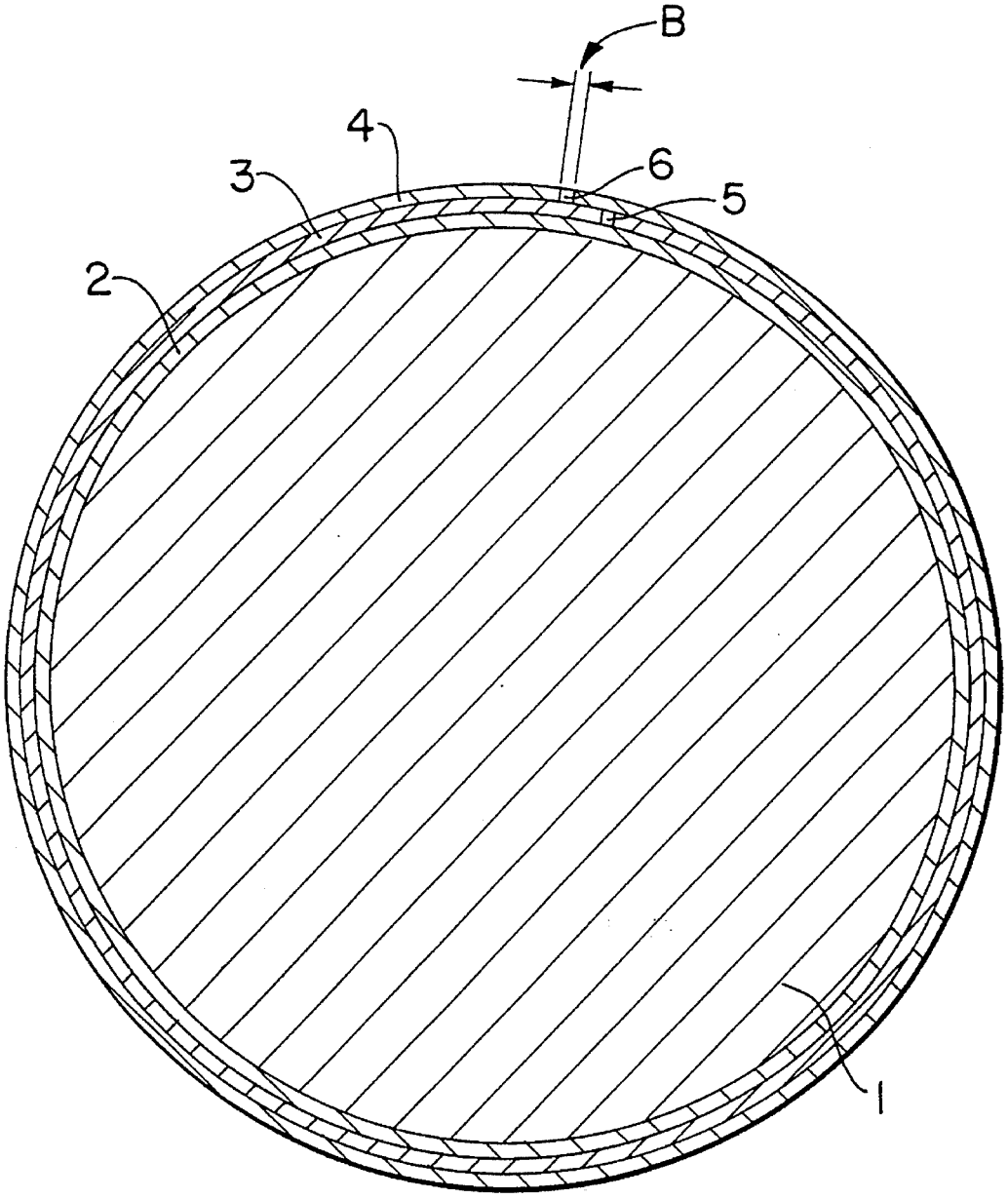
FIG. 1 is a cross-sectional view of a printing form, according to the invention, on a mounting cylinder.

According to FIG. 1, a support 2 in the form of a slightly expandable hollow cylinder is slipped onto a mounting cylinder 1 outside the printing machine, the geometry of the mounting cylinder 1 corresponds to a plate cylinder 15 (FIG. 5) used in the printing machine. Installation and removal are effected in the same way in a known manner, e.g. by means of a compressed-air cushion. The support 2 is enclosed by an adhesive layer 3. In the present case, the adhesive layer is a sheet or foil with adhesive on both sides, the opposite edges being joined on the support 2 at a joint 5. However, the adhesive layer 3 can also be an adhesive agent producing a detachable connection similar to the foil 3. A printing plate 4 of metallic material, preferably aluminum, which is cut to size is placed on the adhesive layer 3. The beginning and ending printing edges of the printing plate 4 are connected with one another at a joint 6 so as to form a sleeve. The joint 6 has a width B of approximately 0.1 mm. The joints 5, 6 are offset relative to one another at the circumference of the mounting cylinder 1 so as to prevent moistening and washing agents from penetrating under the foil 3. The joints 5, 6 can also be sealed with solvent-resistant glues, e.g. silicone-based glues, for the same purpose.

Figure 2:
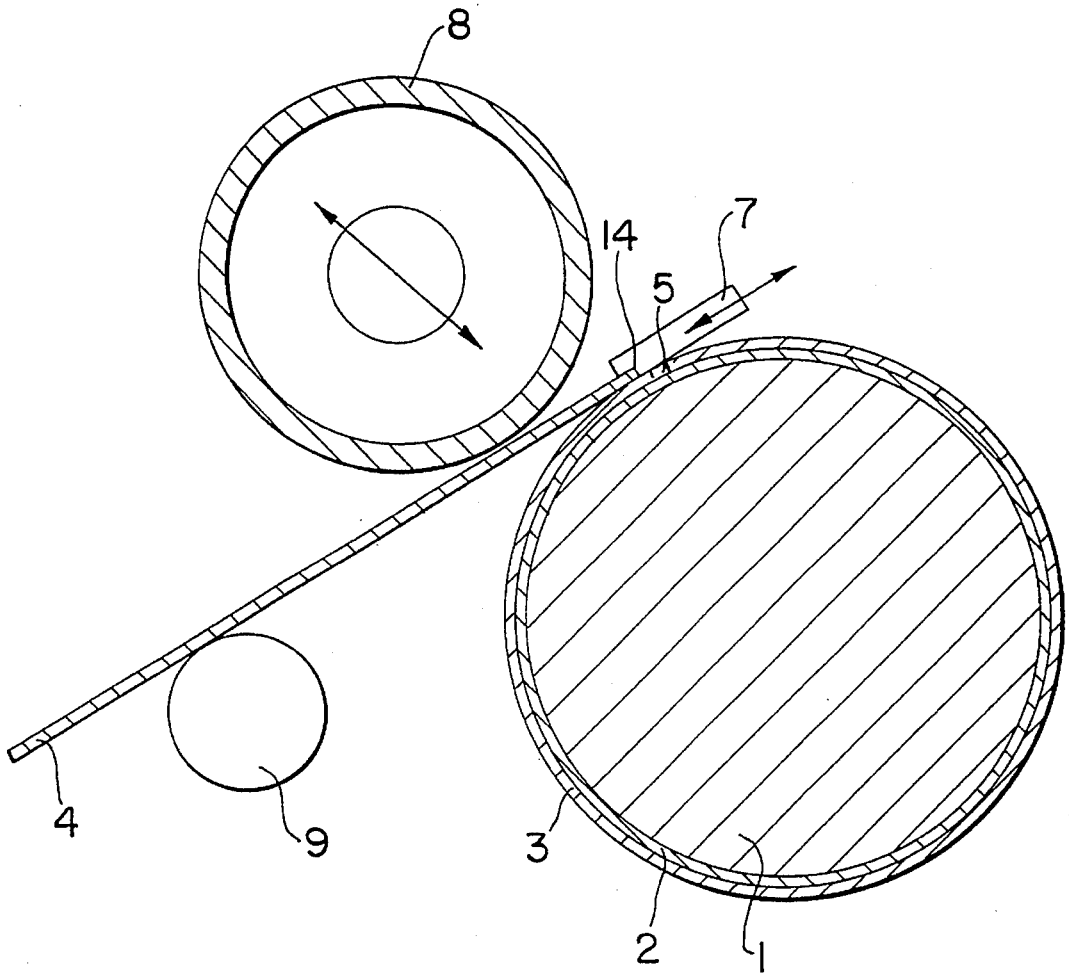
FIGS. 2 to 4 show individual process steps for producing a printing form according to the invention.

The offset printing form 2, 3, 4 is attached to the mounting cylinder 1 outside the machine substantially by the following steps. After pulling the support 2 onto the mounting cylinder 1 and subsequently applying the adhesive layer or foil 3 to the support 2, a stop strip 7, whose axis extends parallel to that of the mounting cylinder 1, is placed on the foil 3 and the printing plate 4, which is cut to size and has been provided with a printing image beforehand, is guided into a stop of the stop strip 7 by its leading front edge 14 (FIG. 2). A supporting roller 9 supports the feeding of the printing plate 4 up to the stop strip 7.

Figure 3:
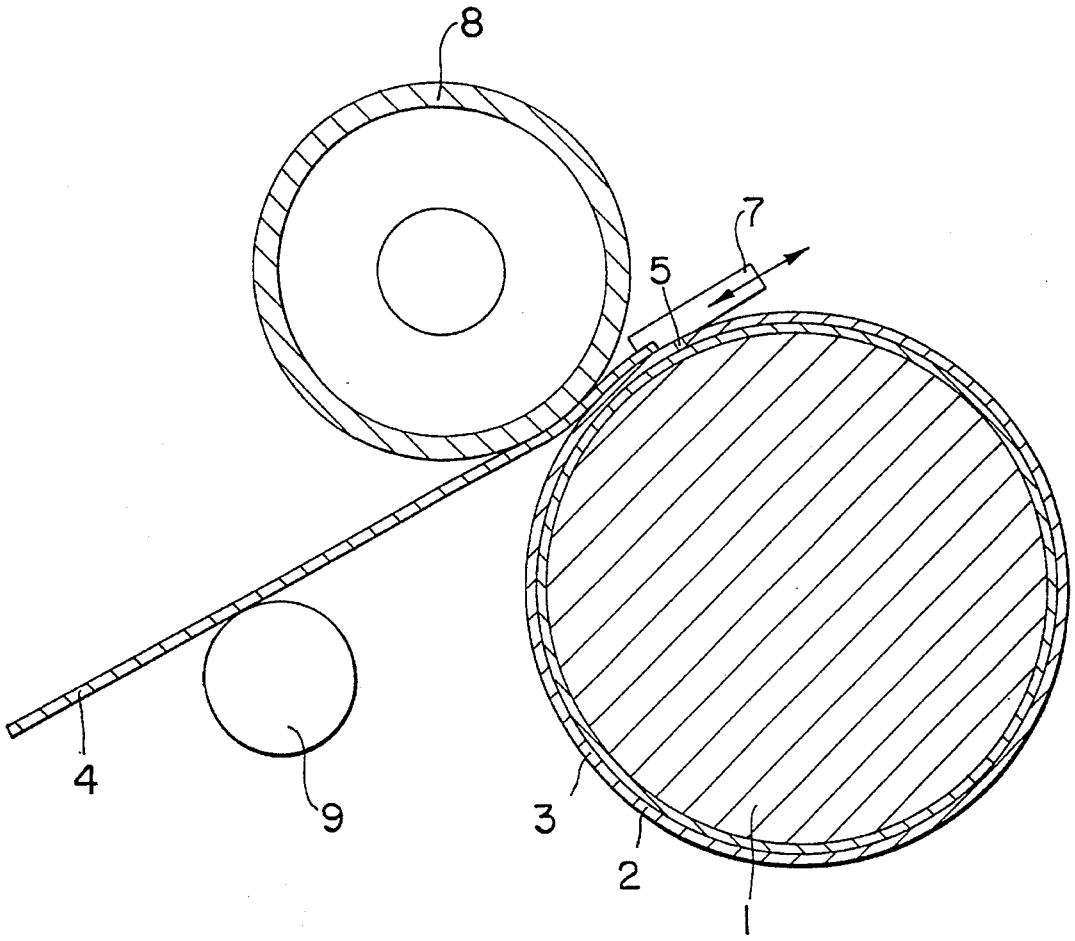

When the front edge 14 sits in the stop strip 7, the printing plate 4 is pressed onto the adhesive layer 3 by contact pressure by means of a rubber contact pressure roller 8 which cooperates with the mounting cylinder 1 (FIG. 3).

Figure 4:
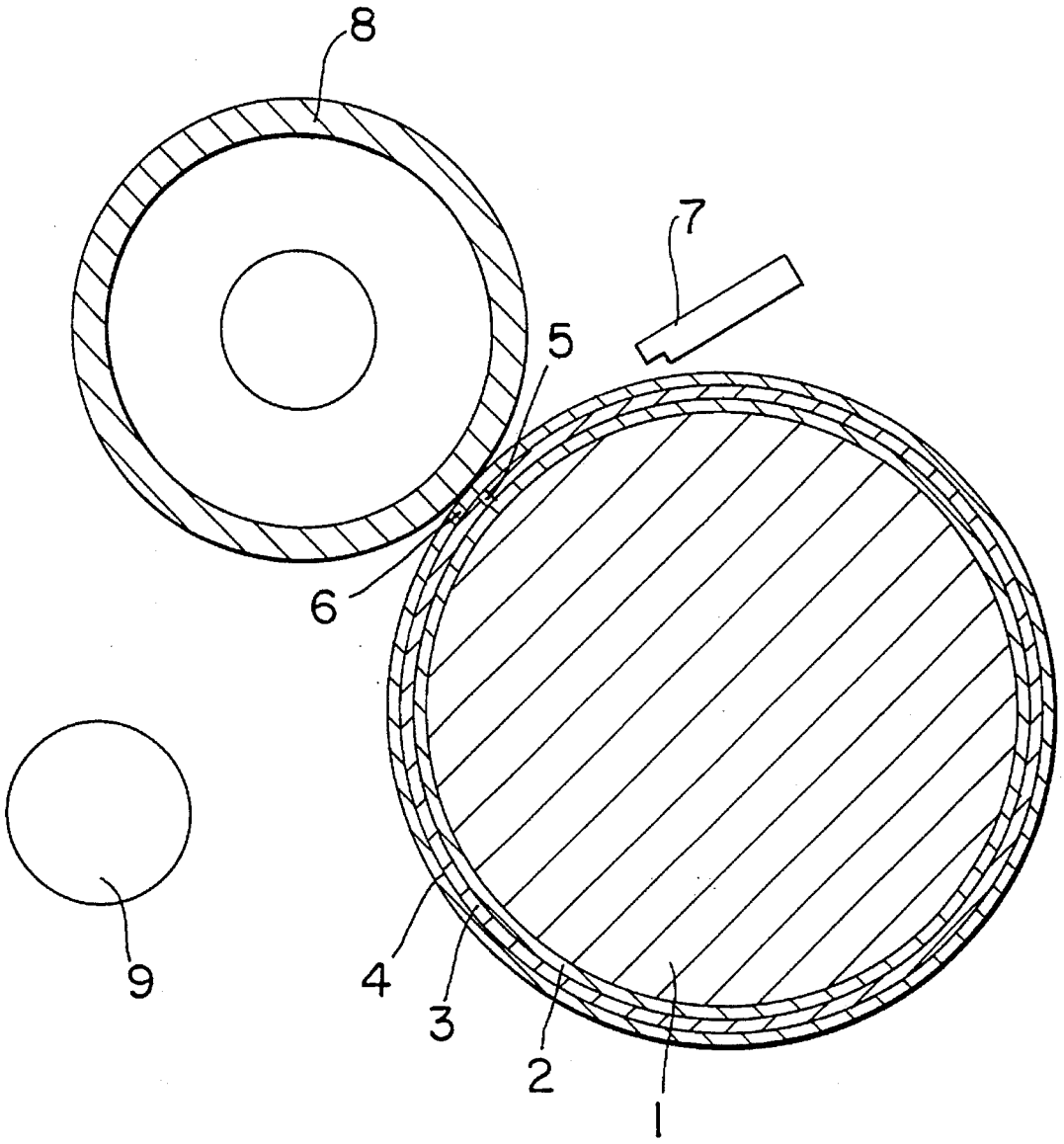

The stop strip 7 is then removed and the printing plate 4 is thoroughly glued to the adhesive layer 3 by means of the corresponding rotating movements of the mounting cylinder 1 and the rubber roller 8 (FIG. 4).

The adhesive layer 3 or foil may be provided with optional thickness so that the printing plate 4 can be adjusted over it as desired. Moreover, production of the printing form need not be restricted to the use of a printing plate. Naturally, a plurality of printing plates cut to the appropriate size can also be glued to the support 2. For this purpose, commercially available adhesives can be used.

As described above, the production of the offset printing form 2, 3, 4 is preferably carried out in the pre-printing stage outside the machine, which considerably reduces machine downtime. However, it is also possible to apply the adhesive layer 3 and the printing plate 4 on the support 2 directly to a form cylinder in the machine. Of course, this takes a considerably longer time due to handling problems.

Figure 5:
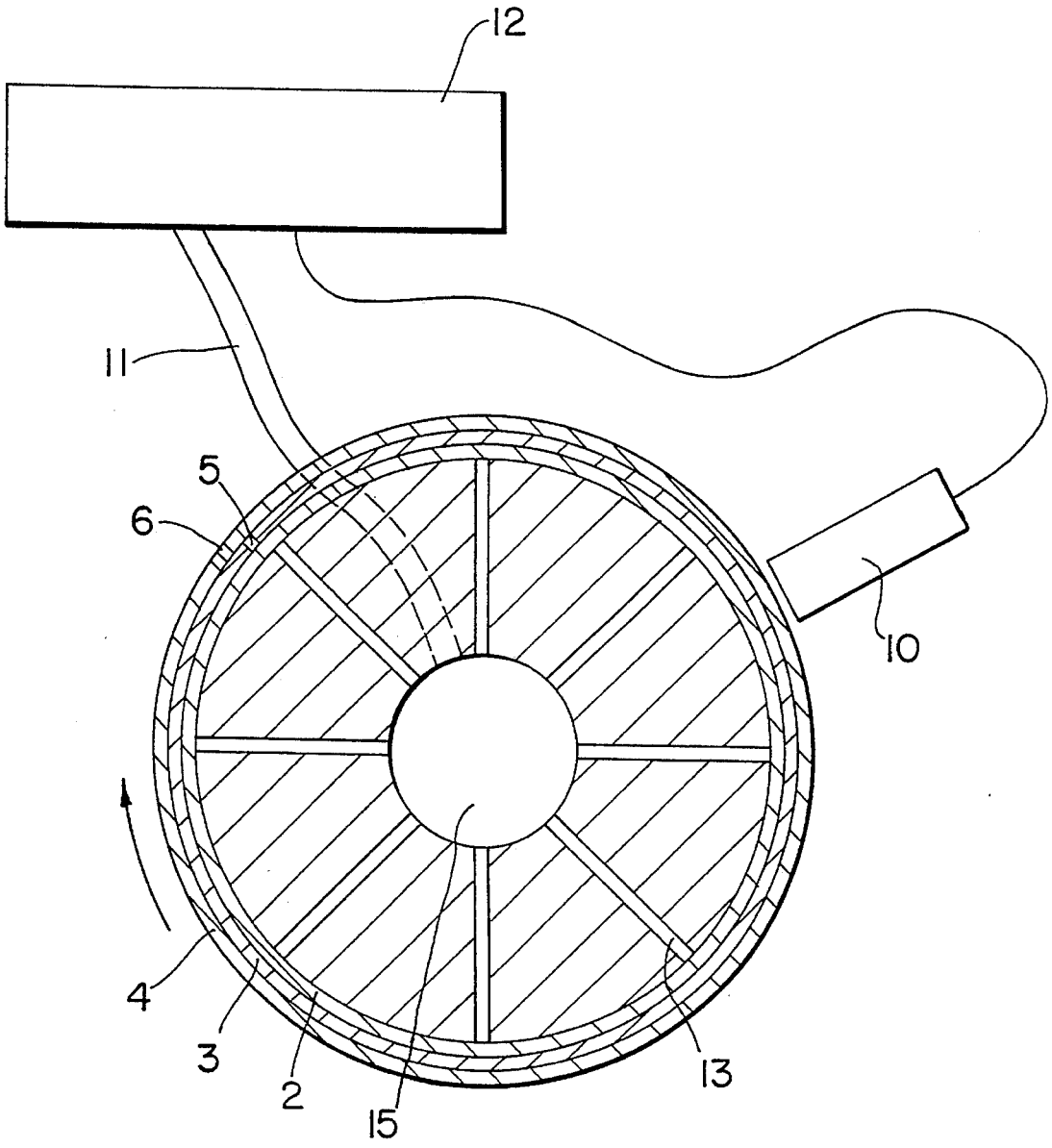
FIG. 5 shows a possible positioning of the sleeve-shaped printing form on a form cylinder in exact register.

As in the prior art, the finished offset printing form is inserted axially on the plate cylinder 15 in a printing unit (FIG. 5). The printing form can be positioned and fastened in exact register by means of a mark, e.g. inside a defined edge area of the printing surface of the printing plate 4 mounted on the support 2. The printing form 2, 3, 4 is acted upon by compressed air when slipped onto the plate cylinder 15 and can be moved axially and radially thereon. The mark is detected by a sensor 10 during the rotating movement of the printing form 2, 3, 4. The sensor 10 turns off the compressed-air feed 11 to branch ducts 13 that extend radially outwardly on the otherwise solid cylinder 15 via a magnetic valve 12.

The printing form 2, 3, 4 is now secured and positioned in correct register since the sensors and marks of the printing forms in the adjacent printing mechanisms are located in the corresponding respective positions.

It is also possible to reuse the support 2 after printing. For this purpose, the offset printing form 2, 3, 4 is again fastened to the mounting cylinder 1 and heated to the softening temperature of the adhesive layer 3 (approximately 100° C.), e.g. by means of hot air. The printing plate 4 and the adhesive layer 3 can then be removed effortlessly and the support 2 can be cleaned with commercial solvents.

The invention is not limited by the embodiments described above which are presented as examples only but can be modified in various ways within the scope of protection defined by the appended patent claims.

I claim:

1. An offset printing form, comprising: at least one cut to size metallic printing plate having starting and ending printing edges; a joint that connects the starting and ending edges with one another so as to form a sleeve; a support for the printing plate, the support being formed as a slightly expandable hollow cylinder; and an adhesive layer covering the support, the printing plate being placed on the adhesive layer, the adhesive layer being an adhesive agent that produces a detachable connection between the printing, plate and the support.

2. An offset printing form according to claim 1, wherein the adhesive agent is a double-sided adhesive foil having ends, and further including a joint that connects the ends of the foil.

3. An offset printing form according to claim 2, wherein the joints of the printing plate and the foil are arranged so as to be offset relative to one another on the circumference of the support.

4. An offset printing form according to claim 3, wherein the joints are sealed by a solvent-resistant glue.

5. An offset printing form according to claim 1, wherein a sensor detectable register mark is arranged on the surface of the printing plate.

* * * * *